United States Patent [19]

Salusbury-Hughes

[11] Patent Number: 4,753,185

[45] Date of Patent: Jun. 28, 1988

[54] FLOATING VESSELS

[75] Inventor: David K. C. Salusbury-Hughes, Dens of Balquhindachy by Methlick, Scotland

[73] Assignee: Marvin Steve Worley, Houston, Tex.

[21] Appl. No.: 47,548

[22] Filed: May 6, 1987

Related U.S. Application Data

[63] Continuation of Ser. No. 840,095, Mar. 17, 1986, abandoned, which is a continuation-in-part of Ser. No. 596,712, Apr. 4, 1984, abandoned.

[30] Foreign Application Priority Data

Apr. 5, 1983 [GB] United Kingdom ..... 8309192

[51] Int. Cl.[4] ..... B63B 3/04; B63B 21/50; B63B 39/03

[52] U.S. Cl. ..... 114/61; 114/125; 114/230; 114/256

[58] Field of Search ..... 114/265, 256, 140, 125, 114/61, 56, 230, 293

[56] References Cited

U.S. PATENT DOCUMENTS

| | | | |
|---|---|---|---|
| 1,285,182 | 11/1918 | Hoffman | 114/61 |
| 1,757,174 | 5/1930 | Douglas | 114/61 |
| 3,271,964 | 9/1966 | Wolff | 114/265 X |
| 3,490,406 | 1/1970 | O'Reilly et al. | 114/265 |
| 3,590,407 | 7/1971 | Bratianu et al. | 114/265 |
| 3,610,193 | 10/1971 | Lacy et al. | 114/265 |
| 3,673,974 | 7/1972 | Harper | 114/265 |
| 3,830,176 | 8/1974 | Arita et al. | 114/265 |
| 4,032,277 | 7/1977 | Schaper | 114/293 X |

OTHER PUBLICATIONS

M. H. Patel, "On the Hydrodynamics of Tandem-Hull Marine Vehicles", Journal of Ship Research, vol. 30, No. 4, Dec. 1986, pp. 275–286.

*Primary Examiner*—Sherman D. Basinger
*Attorney, Agent, or Firm*—Wenderoth, Lind & Ponack

[57] ABSTRACT

A vessel includes two or more barge form hulls disposed apart vertically one above the other and multiple spaced connecting structural members rigidly interconnecting the hulls with a gap therebetween. The upper hull provides the necessary buoyancy to support the vessel with the other hull or hulls flooded with sea water and/or other liquids. Waves acting on the vessel may cause a water flow in the space between the hulls and the wave energy may be at least partially dissipated by the action of the water flow between the hulls and on the connecting members.

19 Claims, 14 Drawing Sheets

FIG. 14.
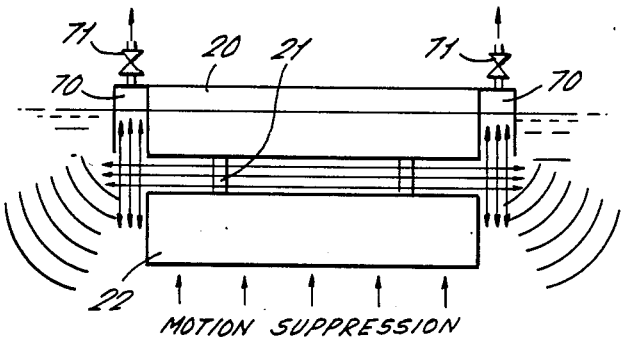
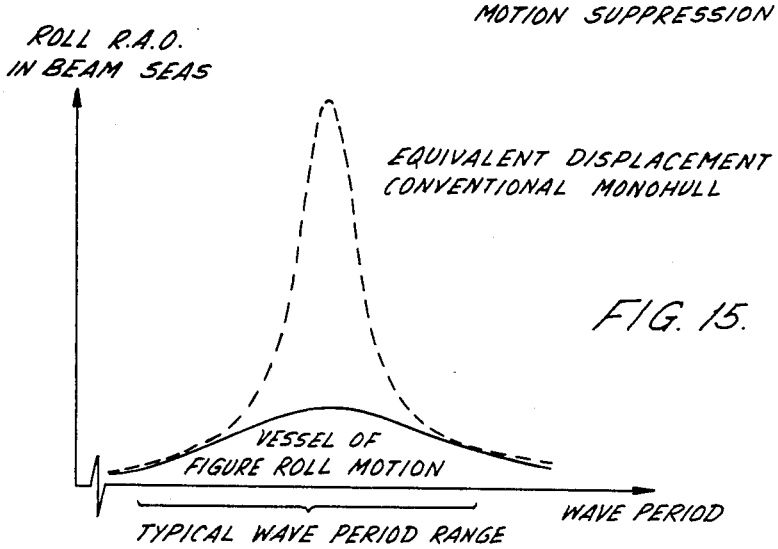
FIG. 15.

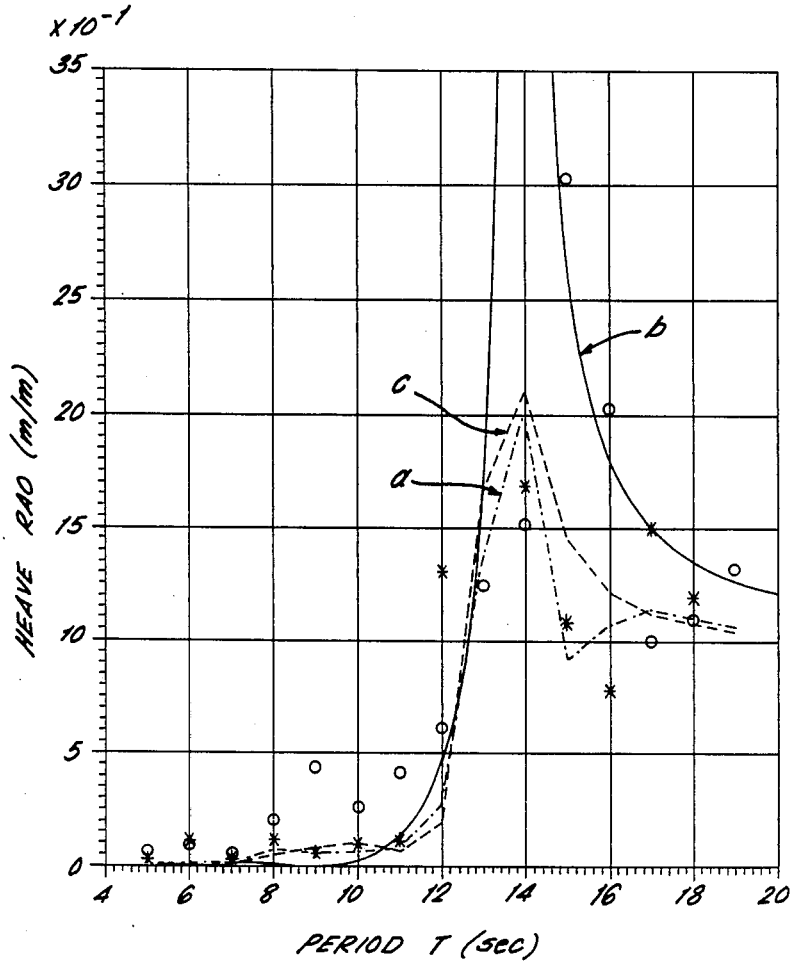
FIG. 19 : HEAVE MOTION IN HEAD SEAS
HULL A: a - DIFFRACTION THEORY, ○ - MODEL TESTS;
HULL B: b - SIMPLIFIED ANALYSIS, c - DIFFRACTION THEORY, ✳ - MODEL TESTS

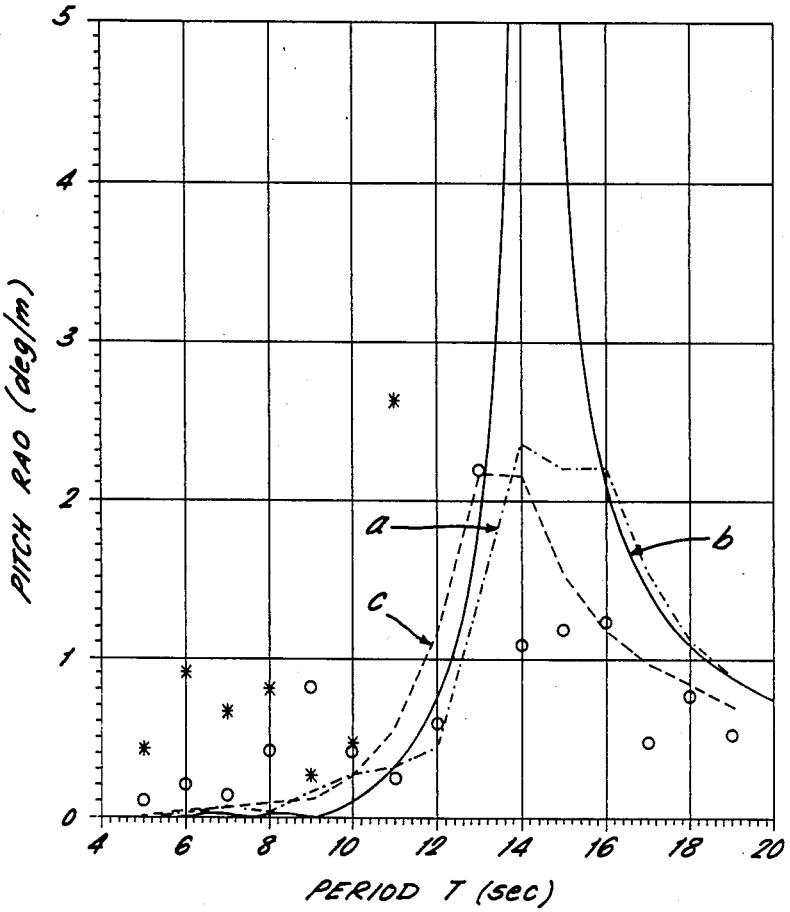
FIG. 20: PITCH MOTION IN HEAD SEAS
HULL A : a - DIFFRACTION THEORY, ○ - MODEL TESTS ;
HULL B : b - SIMPLIFIED ANALYSIS, C - DIFFRACTION THEORY, ✳ - MODEL TESTS

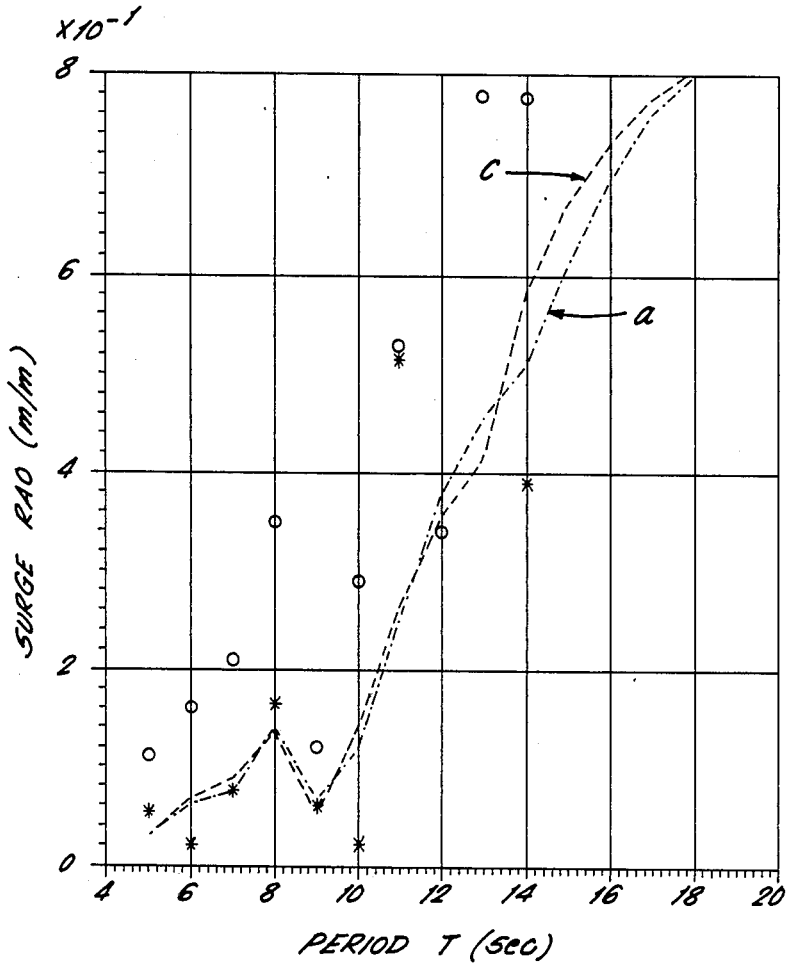
FIG. 21: SURGE MOTION IN HEAD SEAS
HULL A: a - DIFFRACTION THEORY, ○ - MODEL TESTS;
HULL B: c - DIFFRACTION THEORY, ✳ - MODEL TESTS

FLOATING VESSELS

This is a continuation of application Ser. No. 840,095, filed Mar. 17, 1986 and now abandoned, which is a continuation-in-part of now abandoned application Ser. No. 596,712, filed Apr. 4, 1984.

BACKGROUND OF THE INVENTION

1. Field of the Invention

This invention relates to constructions of floating vessels and to arrangements for effecting stabilization and steadiness of such vessels.

2. Description of the Prior Art

U.S. Pat. Nos. 3,271,964, 3,490,406, 3,610,193, 3,673,974 and 3,830,176 all disclose semi-submersible vessels or offshore rigs.

Semi-submersibles, monohull vessels and, in some cases, jack-up type rigs provide alternatives to conventional fixed jackets for supporting process facilities. However, the deck space, payload and storage capacities required cannot always be met by existing semi-submersibles or jack-up designs and in some field locations wave induced motions can impede continuous process operations on some monohull process and storage vessels.

Fundamental requirements for floating vessels indicated the need for the following characteristics:

The wide variety of processing facilities can require large deck spaces and high payload capacities.

A floating process vessel's motions response to waves must be sufficiently small that down time of motion sensitive process equipment is kept to an insignificant level.

Both semi-submersibles and monohull surface vessels have shortcomings when viewed against the above criteria. Semi-submersibles have low wave induced motion characteristics but suffer from low payload capacity. Monohull vessels, on the other hand, offer high payload capacity but have higher wave induced motions than semi-submersibles.

The low wave induced motions of semi-submersibles are due to the open "space frame" pontoon/column configuration which allows inertia and pressure induced wave forces to partially cancel each other, thereby reducing the level of wave forces on the vessel. The low waterplane area of a semi-submersible also gives rise to high natural periods which are helpful to vessel motions at predominantly occurring wave periods. In contrast a monohull vessel achieves its high load carrying capacity due to its large waterplane area but this contributes to its relatively higher wave induced motions.

In floating vessels, stability and wave included motions impose conflicting demands on the vessel design. Adequate stability requires high hydrostatic "stiffness" (in roll or pitch) of the vessel whereas low wave induced motions are obtained by keeping the hydrostatic stiffness to low values.

It is an object of the present invention to devise a vessel having lower motion response to waves at predominantly occurring wave periods as compared with a typical equivalent monohull vessel while providing a higher payload capacity than an equivalent semi-submersible.

SUMMARY OF THE INVENTION

The invention provides a vessel comprising an upper hull, a lower hull and structural means rigidly connecting the upper and lower hulls together with a gap between the hulls extending the length thereof, the hulls being ballasted so that the vessel floats normally with the lower hull fully submerged and the upper hull partially submerged, the gap between the upper and lower hulls being less than the sum of the normal draft of the upper hull and the depth of the lower hull. Preferably the gap between the upper and lower hulls of the vessel is less than the larger of the normal draft of the upper hull and the depth of the lower hull. More specifically the gap between the hulls may be less than the smaller of the normal draft of the upper hull and the depth of the lower hull. Further, the gap between the upper and lower hulls may be less than half of the sum of the normal draft of the upper hull and depth of the lower hull.

In any of the above arrangements, the waterplane area of the upper hull of the vessel and the submerged volume of the lower hull of the vessel may be selected so that the natural frequency of heave of the vessel is in the range 10 to 19 seconds. More specifically, the waterplane area of the upper hull and the submerged volume of the lower hull are selected so that the natural frequency in heave of the vessel is in the range 12 to 18 seconds. In any of the above arrangements, the waterplane area of the upper hull and submerged volume of the lower hull may be selected so that motion of the vessel is minimized for wave frequencies up to 10 seconds. Also, in any of the above arrangements the structural means connecting the hulls together comprise a multiplicity of vertical and/or vertically inclined structural members extending between the hulls, for example fore and aft rows of inter-connecting members may be provided between the hulls. The rows of structural members may be provided between the hulls adjacent the sides of the hulls and also along the center line of the hulls. In addition, lattice members may also be provided interconnecting the lower ends of the structural members to the upper ends of adjacent structural members on the hull above. In accordance with a further feature of the invention, each hull of the vessel may be of barge form. In accordance with a further feature of the invention, the lower hull of the vessel may have a plurality of storage/ballast tanks to receive sea water or a liquid to be stored and means are provided for filling and emptying the tanks as required to thereby maintain the buoyancy of the lower hull negative so that the vessel floats with a water line through the upper hull. In accordance with a further feature, the upper hull may have a plurality of storage tanks and means may be provided for filling and emptying the tanks as required.

In any of the above arrangements, a vertically rotatable turret may be mounted in the hulls of the vessel towards one end of the vessel and means are provided for attaching an anchor system to the turret for mooring the vessel, the turret being freely rotatable with respect to the hulls of the vessel to allow the vessel to lie according to the dictates of the prevailing winds/current/wave direction. For example the hulls may have axially aligned wells extending therethrough on the center line adjacent one end of the vessel, the turret extends through the wells and bearing means are provided for mounting the turret for rotation in the wells to receive said anchor system.

BRIEF DESCRIPTION OF THE DRAWINGS

FIG. 14 is a diagrammatic view of a motion suppression system fitted to the vessel;

FIG. 15 is a graph showing "roll" plotted against "wave period" showing the reduction in "roll" obtained using the motion suppression system as compared with the roll of a conventional monohull;

FIGS. 19 to 21 are graphs showing heave of the vessel in comparison to conventional and semi-submersible vessels.

DESCRIPTION OF THE PREFERRED EMBODIMENTS

Figure 1:
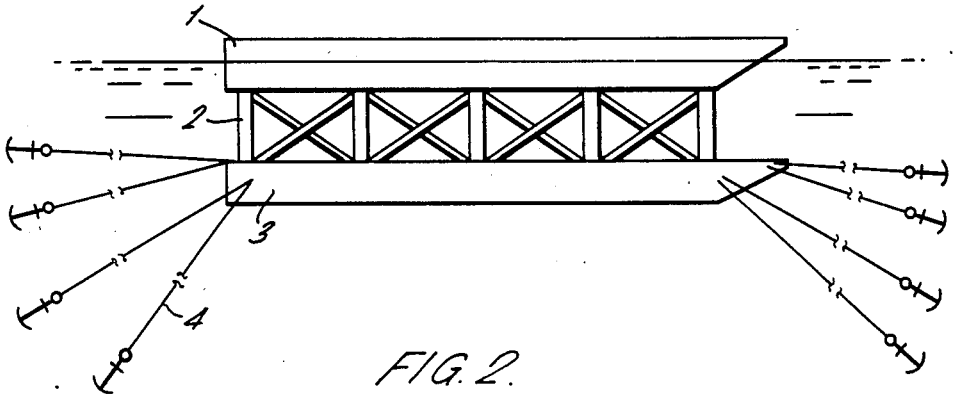
FIG. 1 is a side elevation of a vessel.
Figure 2:
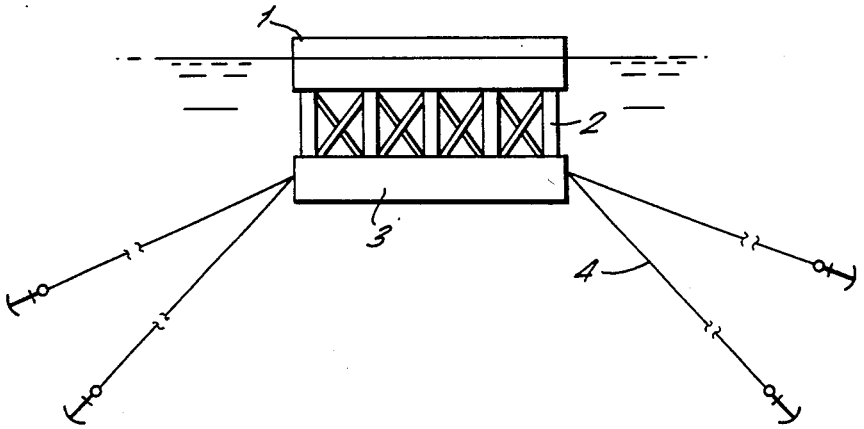
FIG. 2 is an end elevation of the vessel.
Figure 3:
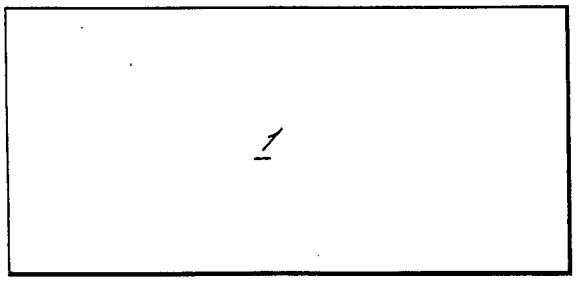
FIG. 3 is a plan view of the vessel.

Referring firstly to FIGS. 1 to 3 of the drawings, 1 is an upper water buoyant hull connected through support and bracing members 2 with a lower hull 3 which may supply none or some of the buoyancy of the total structure. The lower hull is anchored at connections 4. The gap between the upper and lower hulls is less than the combined draft of the upper hull and lower hull for reasons which will be explained below.

Having described an embodiment of the invention in broad outline form, reference will now be made to FIGS. 4 to 12 in which a more detailed embodiment of the invention is illustrated. The vessel which is intended as a floating production unit for a sea-bed oil well comprises an upper "barge form" hull 20 which may measure 400 ft by 100 ft by 25 ft deep and is attached by an intermediate braced steel structure indicated generally at 21 to a lower barge form hull 22 somewhat smaller than the upper hull and for example measuring 300 ft by 90 ft by 20 ft deep and spaced below the upper hull by said structure.

The upper hull has a deck superstructure 20*a* at the stern thereof which houses all the required accommodation, offices, workshops and process control room and other such services and over which extends a helicopter landing deck 20*b* for which associated fire and damage control stations and re-fuelling/de-fuelling facilities are provided. A ballast control center is provided within the accommodation unit which houses controls for levels in ballast tanks for both the upper and lower hulls.

Within the body of the upper hull 20 there are the following compartments;

i. trim and ballast tanks.
ii. ballast manifold and pumps.
iii. chain lockers and fairleads.
iv. motion suppression tanks.
v. platform utilities.
vi. power generation and distribution.
vii. water injection pump.
viii. oil surge tanks.
ix. produced water settling tanks.

As shown diagramatically in FIG. 2, the lower hull 22 contains ballast piping 20*c* which connects through to the ballast manifold and pumps located in the upper hull and also has ballast tanks to render the buoyancy of the lower hull negative so that the vessel floats with a water line through the upper hull.

Figure 5:
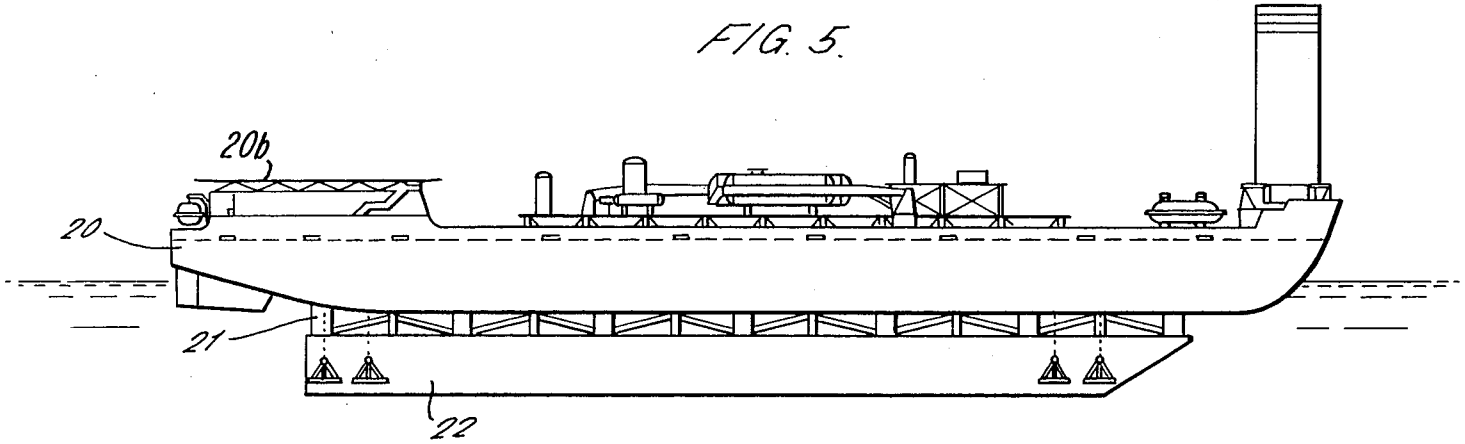
FIG. 5 is a side elevation view of the vessel of FIG. 4.

FIG. 5 of the drawings shows the vessel in side elevation with the upper hull 20 floating to its normal waterline and the lower hull 22 flooded with sea water and fully submerged.

Figure 7:
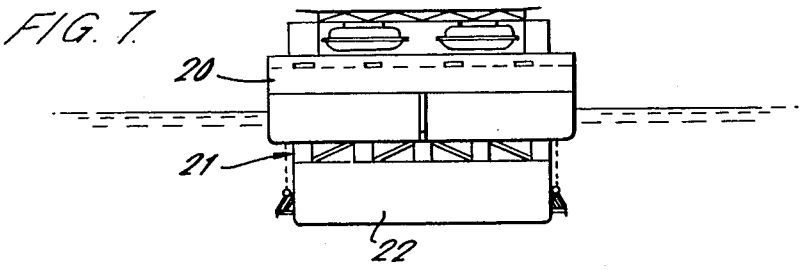
FIG. 7 is a stern view of the vessel.
Figure 8:
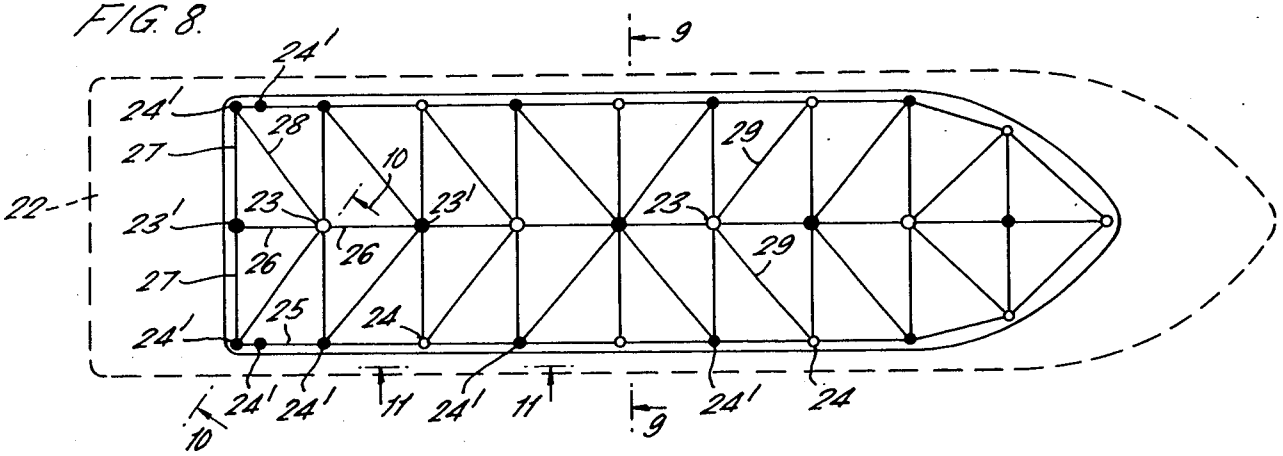
FIG. 8 is a plan view taken between the upper and lower hulls of the vessel of FIG. 5.

The structure connecting the upper and lower hulls is shown in detail in FIGS. 8 to 11 and comprises a row of upright columns 23 extending between the flat bottom of the upper hull and the flat deck of the lower hull along the centerline of the hulls and further rows of columns 24 extending along either side of the hulls. Alternate columns along the center line denoted 23′ extend from the keel of the lower hull, up through that hull, across the gap between the hulls and up through the upper hull to the deck of the upper hull whereas the remaining columns interposed alternately between the columns 23′ extend between the upper deck of the lower hull and the underside of the upper hull. Likewise, in the rows of columns 24 along either side of the vessel, alternate columns marked 24′ extend from the keel of the lower hull to the deck of the upper hull whereas the remaining columns extend between the deck of the lower hull to the underside of the upper hull. At the stern of the vessel, all the columns extend from the keel of the lower hull to the deck of the upper hull. In addition, in each line of columns, the base of each column 24′ is connected by bracing members 25 to the upper end of the intermediate column 24 and likewise the base of each column 23′ is connected by bracing members 26 to the upper end of the intermediate column 23. Across the vessel, the base of each outer column 24 is connected to the upper end of the column 23 in line with the columns 24 by bracing members 27. Further, in the rearward part of the vessel the lower ends of the outer columns 24 are connected by bracing members 28 to the upper end of the column 23 one step forward along the center line of the vessel. Likewise, the lower ends of the columns 24 in the forward part of the vessel are connected by bracing members 29 to the upper ends of the center line columns 23 one step to the rear in each case. The structure 21 inter-connecting the hulls as illustrated in FIGS. 5 and 7 is somewhat simplified for the sake of clarity.

The upper hull of the vessel incorporates a crude oil surge tank at atmospheric pressure from which pumps deliver crude oil via a metering unit to a tanker loading terminal. Surge tank capacity is selected to allow sufficient buffer storage for normal tanker turnaround. The lower hull can however be designed to provide a further oil storage if required. The low center of gravity of the vessel allows production equipment to be stacked in multiple levels or to be enclosed for weather protection in severe environments. The vessel can thus accommodate oil and gas production systems together with associated water injection and gas conditioning and compression systems. All production operations and marine systems are controlled and monitored from a central control room in the accommodation block.

The ballasting control systems also permit full de-ballasting of the lower hull in suitable weather conditions to make it possible to raise the vessel for dry access to the whole of the upper hull and inter-hull structure. The vessel can thus be readily inspected for re-certification survey requirements on site without the necessity for dry-docking. The de-ballasting facility also enables the vessel to be floated out from its construction site with a minimum draft before ballasting on site to its full draft.

Figure 4:
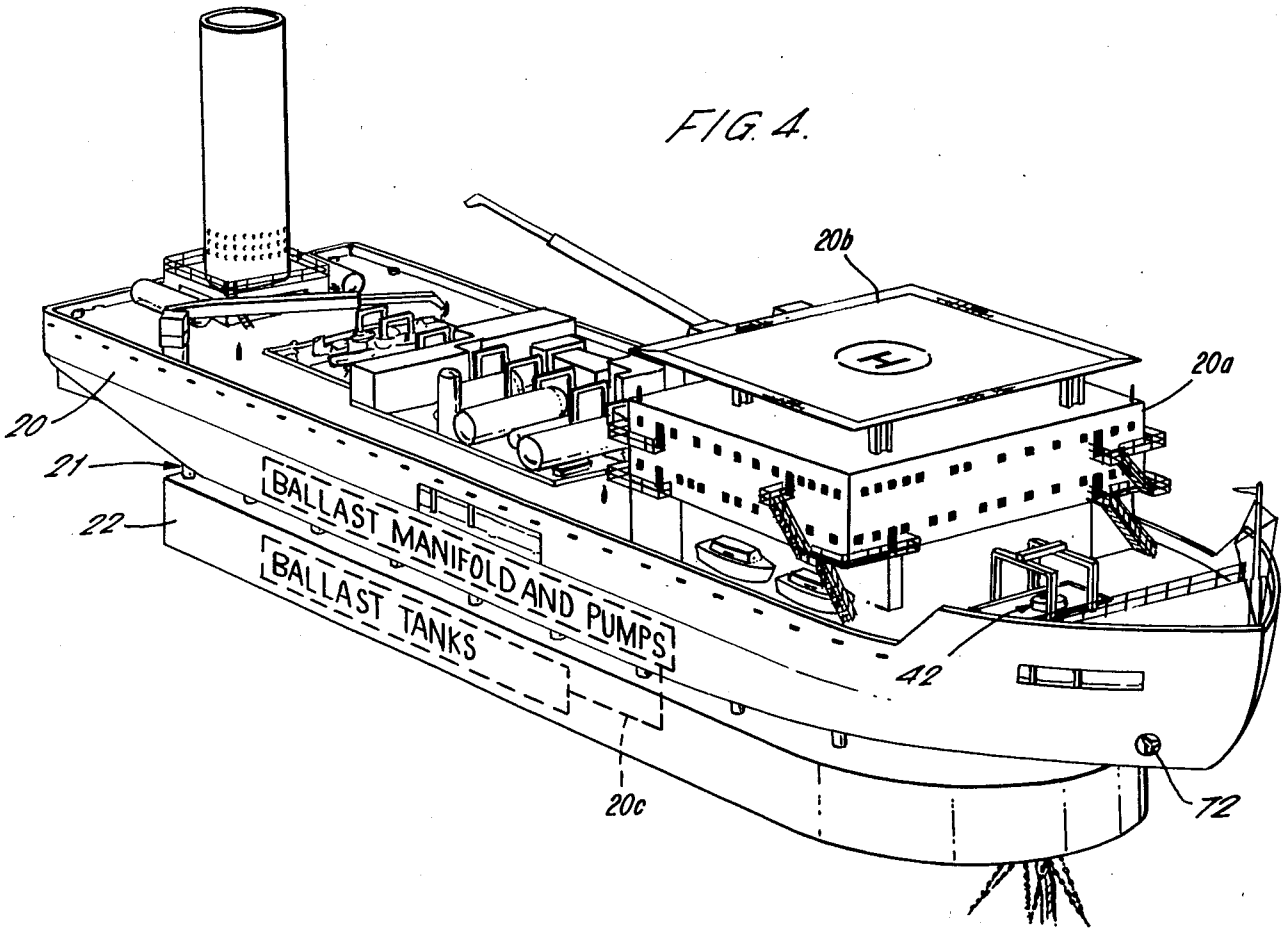
FIG. 4 is a perspective view of a vessel according to another embodiment of the invention.
Figure 6:
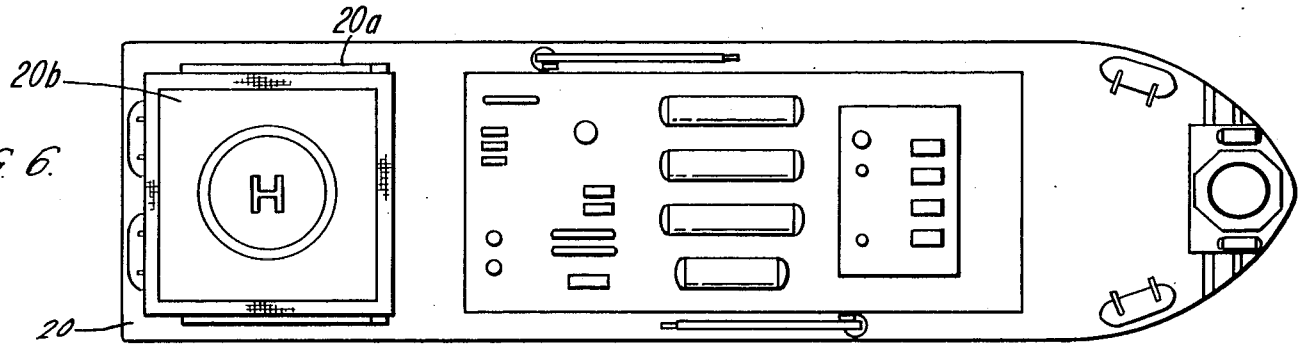
FIG. 6 is a plan view of the vessel.

The vessel may also be provided with a thruster or thrusters on either or both of the hulls as indicated at 72 in FIG. 4 for driving maneuvering the vessel.

Figure 9:
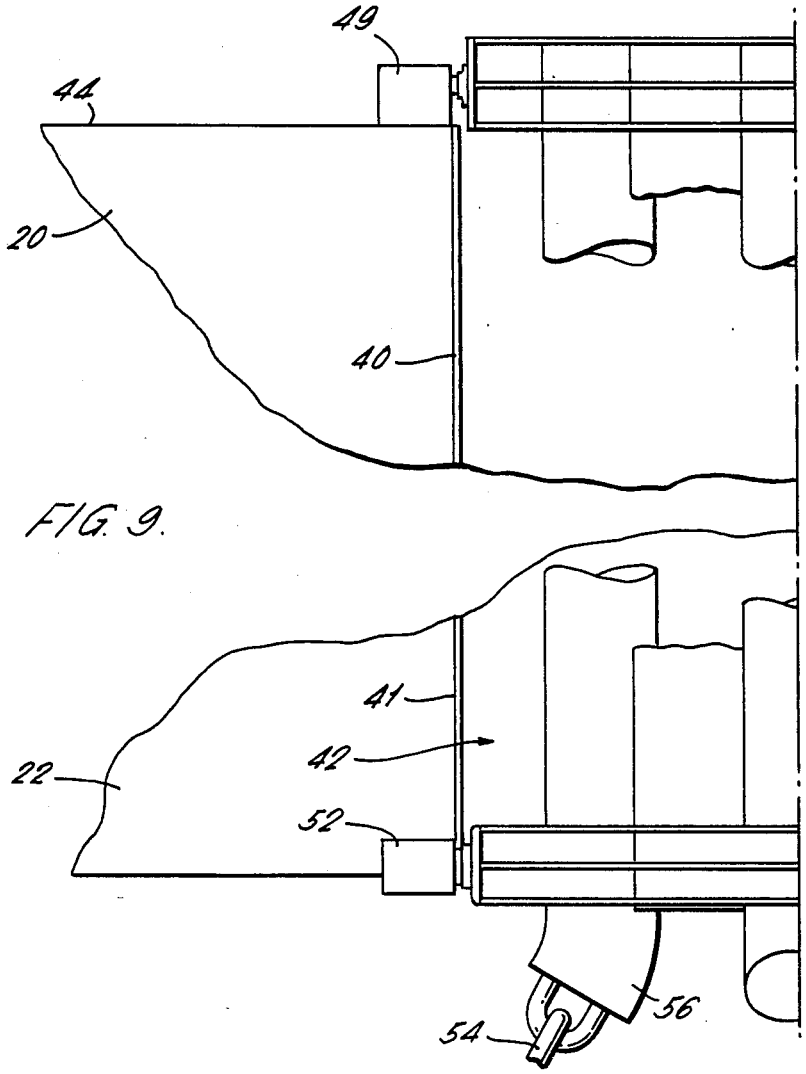
FIG. 9 is a diagrammatic section of a forward part of the vessel showing an anchor system and riser attachment mounting on the vessel.
Figure 10:
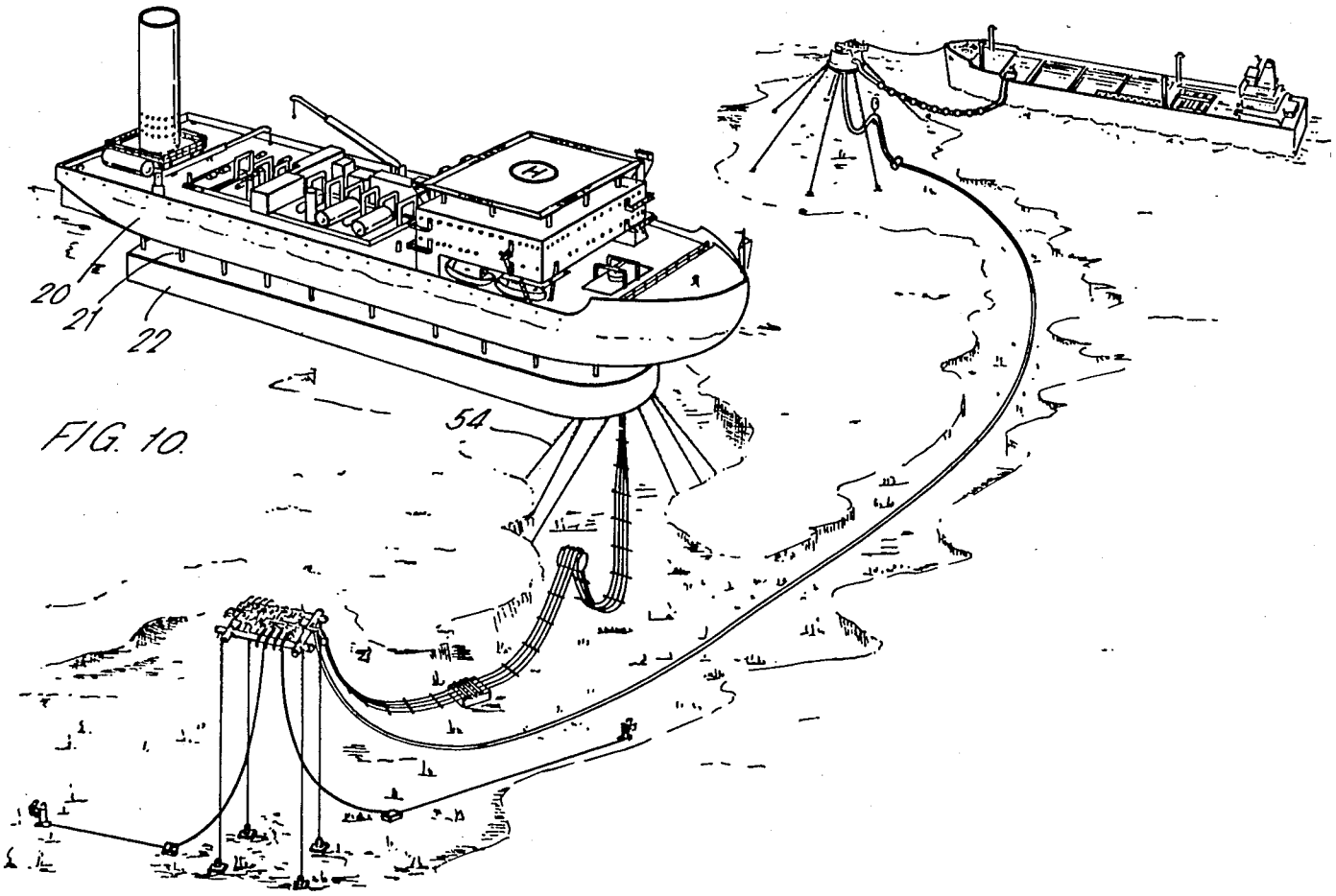
FIG. 10 is a diagrammatic perspective view of the vessel at anchor.
Figure 16:
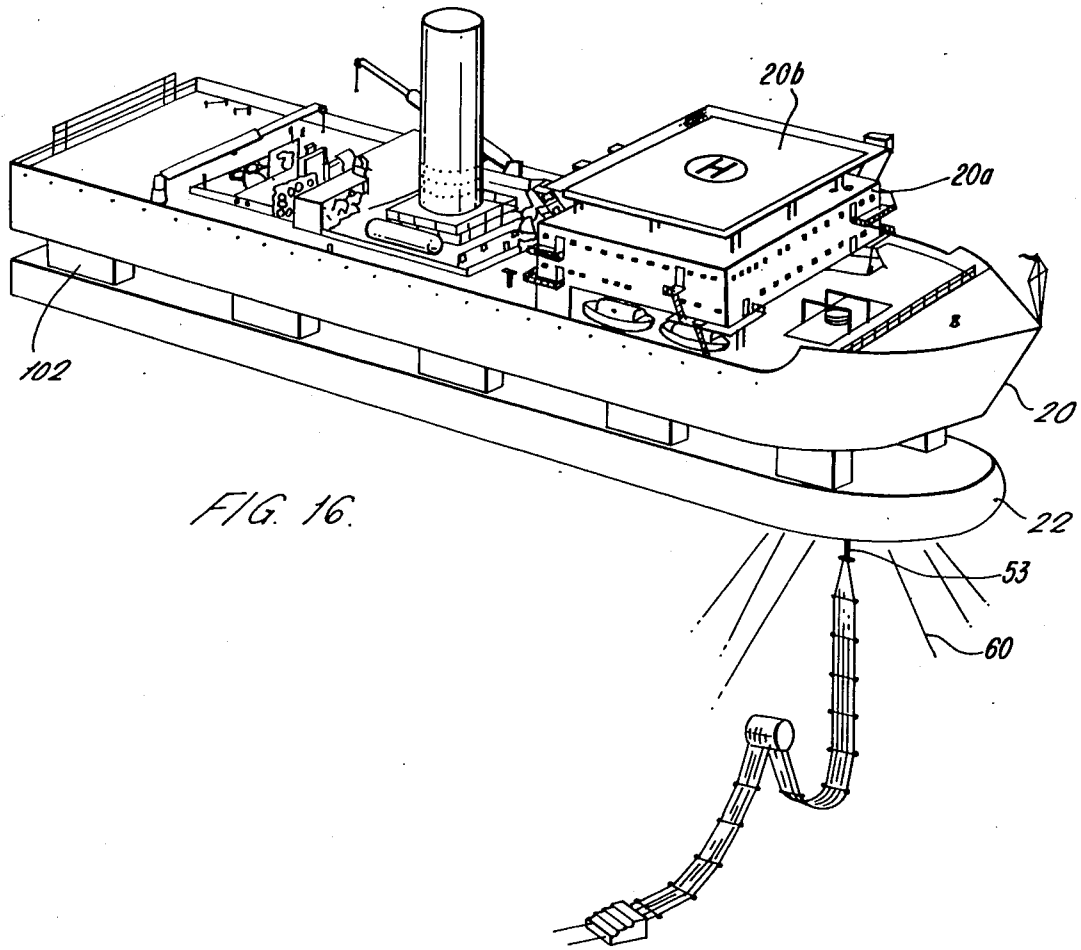
FIG. 16 is a perspective view of a modified form of the vessel with a mooring turret and catenary leg mooring arrangement.

Towards the forward end of the vessel, as shown in FIG. 9, the upper and lower hulls are formed with axially aligned cylindrical wells 40, 41 respectively in which a rotary turret structure indicated at 42 is mounted in upper and lower bearings indicated at 49 and 52. The turret 42 carries the upper end of a marine riser indicated generally at 53, as shown in FIG. 16, to which a pipeline or pipelines are connected from below the surface to provide the appropriate feeds and supplies. Six anchor chains 54 are secured at their upper ends to the turret 42 and the chains extend downwardly through the turret and out through hawse-pipes 56 mounted in the lower part of the turret to extend in catenary manner to anchors on the sea bed. The anchoring arrangement is illustrated in FIG. 10 and it will be seen that the vessel is free to rotate around its anchorage by reason of rotation of the turret in the vessel in accordance with the prevailing conditions of wind, current and waves so that the vessel will automatically weather vane in adverse conditions thus minimizing the effect of those conditions on the motion of the vessel. The vessel is thus able to be maintained in operation in severe conditions.

Figure 11:
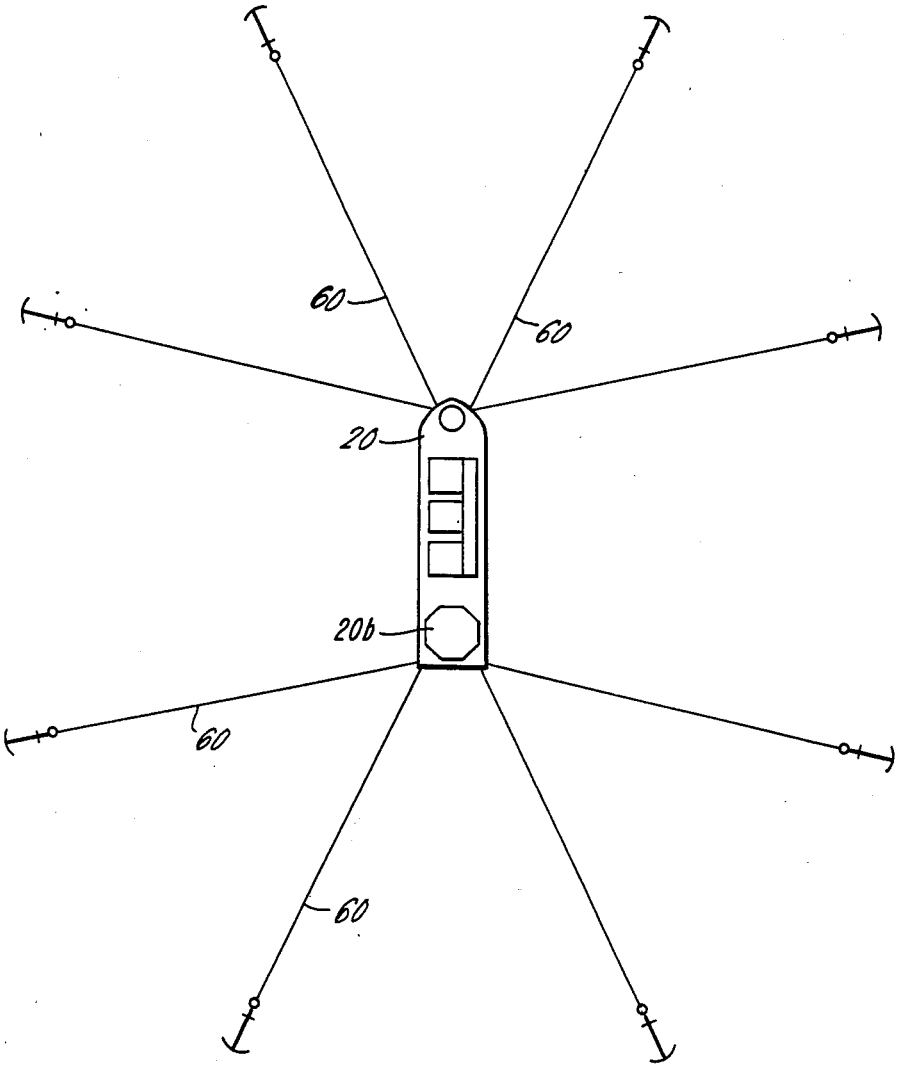
FIG. 11 is a plan view of the vessel held by an alternative mooring arrangement.
Figure 12:
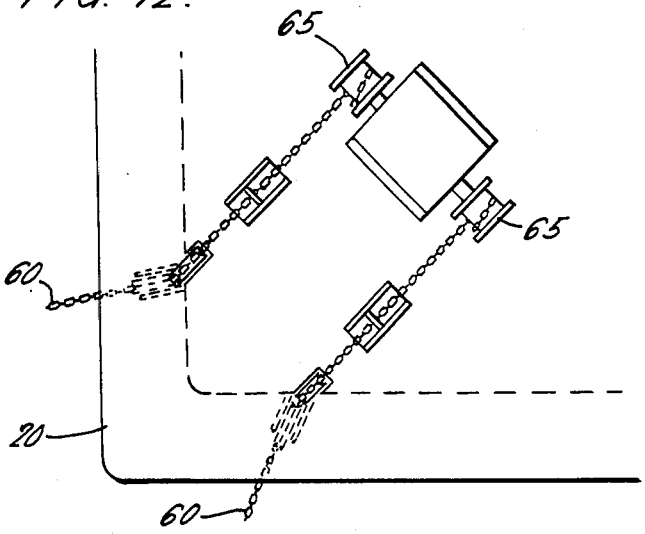
FIGS. 12 and 13 are detailed views of the attachment of the anchor chains to the vessel in the system of FIG. 11.
Figure 13:
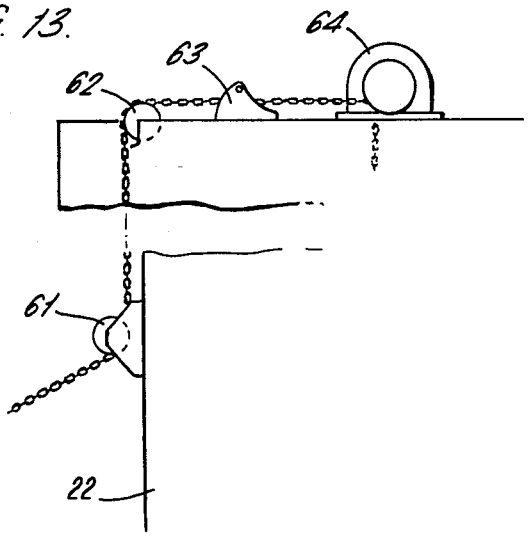

The vessel can also be moored to an eight point catenary anchoring system from the bow and stern of the vessel as illustrated in FIG. 11 in which case anchor chains 60 are connected to the vessel as shown in FIGS. 12 and 13 through side fairleads 61 on the lower hull, fairleads 62 at the deck edge of the upper hull, chain stoppers 63 and electric powered winches 64, each winch being provided with drums 65 at either end of its power shaft to receive pairs of chains 60.

The vessel may also be provided with a proprietary roll motion suppression system as indicated diagrammatically in FIG. 14. For that purpose, the upper hull 20 is provided with downwardly open side tanks 70 having control valves 71 at the upper ends thereof for venting the tanks. The valves can be closed to maintain the water level in the side tanks 70 or open to allow the water level to rise and fall as the vessel moves. Tests using a model of the vessel of FIG. 4 indicate a reduction in roll movement in seas as compared with a conventional monohull vessel of the same displacement as indicated in the graph of FIG. 15.

Figure 17:
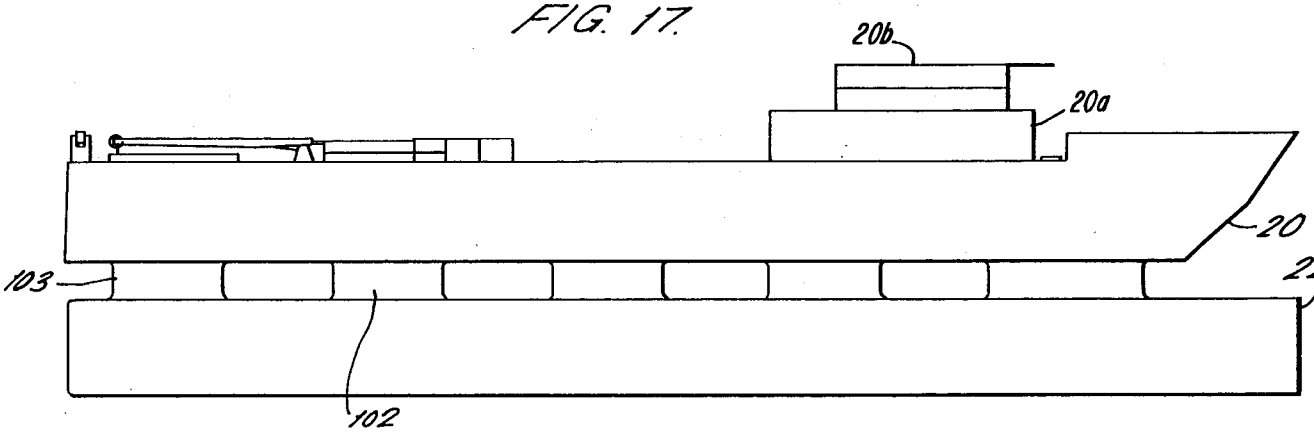
FIG. 17 is a side elevation of such further vessel.
Figure 18:
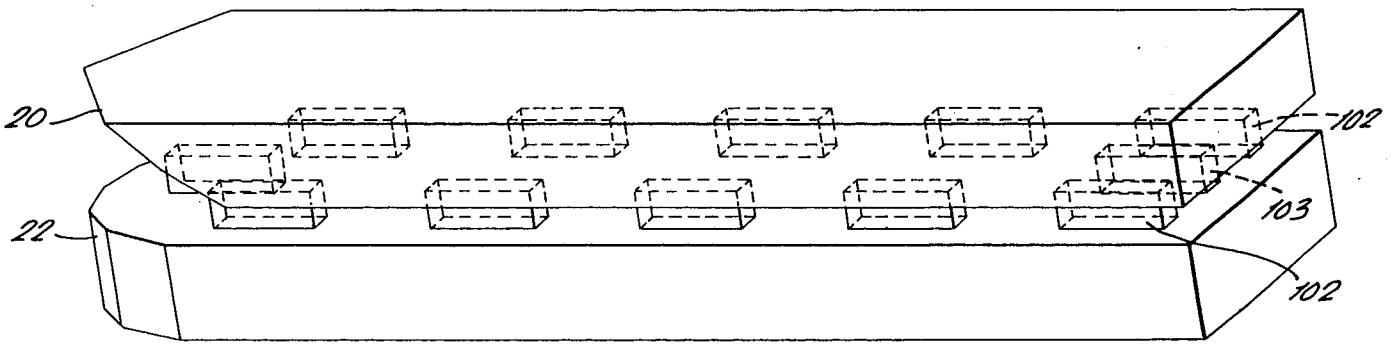
FIG. 18 is a perspective outline drawing of such further vessel.

Referring now to FIGS. 16 and 17 of the drawings, there is shown a further vessel in accordance with the invention which is generally similar to the vessel of FIGS. 4 to 10 and like parts have been allotted the same reference numerals.

The vessel of FIGS. 16 and 17 has a simplified structure connecting the upper and lower hulls comprising a multiplicity of upright columns 102 and 103 of elongate cross-section (in the fore and after direction of the vessel) extending from the keel of the lower hull 22, up through that hull, across the gap between the hulls and up through the upper hull 20 to the deck of the upper hull. The spacing between the lower and upper hulls is less than the draft of the upper and lower hulls combined and typically is half the combined drafts for reasons which are explained in greater detail below.

The twin or tandem hull vessels described above can be regarded as hybrids of monohulls and semi-submersible hulls. The tandem hull however offers significant advantages for a floating production platform due to its hybrid characteristics which yield the most desirable qualities of both monohull and semi-submersible vessels.

The three major performance requirements for a floating production platform are high payload capacity for process plant and oil storage, low motion response to waves and low construction cost. Both semi-submersibles and monohull vessels have shortcomings when viewed against these criteria. Semi-submersibles have low wave induced motion characteristics but suffer from low payload capacity and high construction cost. Monohull vessel solutions, on the other hand, offer high payload capacity and low construction cost but have higher wave induced motions than semi-submersibles. The low wave induced motions of semi-submersibles are due to the open "space frame" pontoon/column configuration which allows inertia and pressure induced wave forces to partially cancel each other, thereby reducing the level of wave forces on the vessel. The low waterplane area of a semi-submersible also gives rise to high natural periods which are helpful to vessel motions at predominant wave periods. In contrast a monohull vessel achieves its high load carrying capacity due to its large water plane area but this contributes to its relatively higher wave induced motions. The tandem hull in accordance with the invention combines the beneficial design features of both conventional monohull vessels and semi-submersibles to satisfy the needs of both high payload capacity and low wave induced motion characteristics.

The gap between the upper and lower hulls is substantially open and the spacing of the hulls is such that the gap is less than the normal draught of the upper hull added to the depth of the lower hull. More specifically the gap is of the order of half that sum. The waterplane area of the upper hull of the vessel and the submerged volume of the lower hull are designed so that the natural frequency of heave of the vessel is in the range 10 to 19 seconds and preferably in the range 12 to 18 seconds and also the motion of the vessel is minimized for heave frequencies up to 10 seconds.

The following is a summary of the essential data for two typical hulls according to the invention:

| Dimensions | | Tandem Hull A | Tandem Hull B |
|---|---|---|---|
| Displacement/tonnes | | 60955 | 58745 |
| Lower Hull | Length/m | 130.5 | 124.0 |
| | Width/m | 32.68 | 32.68 |
| | Height/m | 10.4 | 10.4 |
| | Displacement/tonnes | 43222 | 41012 |

-continued

| Dimensions | | Tandem Hull A | Tandem Hull B |
|---|---|---|---|
| Surface Piercing Hull | Length/m | 124.0 | 124.0 |
| | Width/m | 30.0 | 30.0 |
| | Draught/m | 5.37 | 5.37 |
| | Displacement/ tonnes | 17576 | 17576 |
| | Waterplane Area/sq m | 3031 | 3031 |
| Total Draught/m | | 19.77 | 19.77 |
| Gap Height/m | | 4.0 | 4.0 |
| Equivalent Gap Structure | Length/m | 7.24 | 7.24 |
| | Width/m | 5.43 | 5.43 |
| Height of CG above keel/m | | 9.19 | 9.19 |
| Radians of gyration in pitch/m | | 41.9 | 41.9 |

Summary of Vessel Data (All Displacements For Fresh Water Conditions)

A hydrodynamic analysis has been derived for wave induced heave forces and motions for typical semi-submersible, tandem and monohull vessels to illustrate their hydrodynamic behaviour. The analysis has been complemented by a more representative diffraction theory based hydrodynamic analysis of the hull form to yield wave induced motions and inter-hull forces. Finally, the analyses results have been compared with model tests of the hull form at 1:75th scale for both wave induced motions and inter-hull forces.

FIGS. 19 to 21 present predictions based on both a simplified analysis and on a more detailed diffraction theory together with results of scale model tests in a test tank. Since both tandem hulls A and B had non-rectangular bow shapes, the simplified hydrodynamic analysis for these hulls is carried out by assuming equivalent rectangular hulls of equal volume and by modifying the integration limits of the relevant equation to accommodate an equivalent hull length. FIGS. 19 and 20 show generally reasonable agreement in overall trends between the diffraction theory analysis and model tests for heave and pitch motions. The tandem hull motions are characterized by low motion amplitudes for wave periods up to 12.5 s with high resonant peaks for wave periods around 14 s. There is some disagreement between theory and tests for heave motion of tandem hull A in the heave period range of from 9 to 11 s. This is believed to be due to the effect of the lower hull bow protruding ahead of the upper hull and causing incident waves to exhibit complex local breaking and slamming effects. These were observed during the tests with tandem hull A but were absent from tandem hull B with its shortened lower hull bow.

FIG. 21 presents surge motions in head seas for tandem hulls A and B. The diffraction analyses are in close agreement but again the tandem hull A model test data are at significantly higher values than those for tandem hull B. The effects of complex wave interactions associated with the protruding lower hull are again believed to be responsible for this. Surge motion data above 15 s are influenced by mooring system resonance (not modelled in the dynamic analysis) and are, therefore, not presented in the figure.

It is instructive to note the difference in motion response exhibited by tandem hulls A and B with tandem hull A having the lower waterplane area ratio corresponding to a greater submerged volume.

The tandem hull vessels described above exemplify a design which balances the need for adequate payload capacity from an oil production vessel with low wave induced motions in the frequently occurring operating wave period range of up to xx seconds. Above this wave period, the occurrence of heave and pitch resonant peaks and the consequently larger motions offer further advantages. These are due to the fact that for the much rarer occurrence of severe storms with their characteristic high periods, larger vessel motions lead to better sea-keeping in terms of water on deck and general damage to deck equipment. Thus the freeboard requirements, deck production equipment durability and general vessel survivability are improved while providing a production platform which exhibits very low wave induced motions at the much more frequently occurring operating wave period range.

What is claimed is:

1. A vessel comprising a flat bottomed upper hull and a flat decked lower hull of similar length and beam to the upper hull, structural means comprising a plurality of spaced struts rigidly connecting the upper and lower hulls together with the flat bottom of the upper hull and the flat deck of the lower hull lying in generally parallel planes to provide a gap between the upper and lower hulls extending throughout the length of the hulls, means in the lower hull to hold liquid ballast to render the buoyancy of the lower hull negative so that the vessel floats with a water line through the upper hull, the structural means connecting the upper and lower hulls to provide the gap between the hulls throughout the length of the hulls, the gap being less than the sum of the draft of the upper hull and the depth of the lower hull and means to displace the liquid ballast from the lower hull and to replace it with another liquid ballast.

2. A vessel as claimed in claim 1, wherein the gap between the upper and lower hulls of the vessel is less than whichever is the larger of the draught of the upper hull and the depth of the lower hull.

3. A vessel as claimed in claim 2, wherein the gap between the hulls is less than whichever is the smaller of the draught of the upper hull and the depth of the lower hull.

4. A vessel as claimed in claim 3, wherein the gap between the upper and lower hulls is less than half of the sum of the draught of the upper hull and depth of the lower hull.

5. A vessel as claimed in claim 1, wherein the waterplane area of the upper hull of the vessel and the submerged volume of the lower hull of the vessel are selected so that the natural frequency of heave of the vessel is in the range 10 to 19 seconds.

6. A vessel as claimed in claim 1, wherein the waterplane area of the upper hull and the submerged volume of the lower hull are selected so that the natural frequency in heave of the vessel is in the range 12 to 18 seconds.

7. A vessel as claimed in claim 1, wherein the waterplane area of the upper hull and submerged volume of the lower hull are selected so that motion of the vessel is minimized for wave frequencies up to 10 seconds.

8. A vessel as claimed in claim 1, wherein the structural means connecting the hulls together comprise a plurality of vertical structural members extending between the hulls.

9. A vessel as claimed in claim 8, wherein the structural means connecting the hulls together comprise a plurality of vertical and inclined members extending between the hulls.

10. A vessel as claimed in claim 8, wherein fore and aft rows of interconnecting members are provided between the hulls.

11. A vessel as claimed in claim 8, wherein rows of said structural members are provided between the hulls adjacent the sides of the hulls and also along the center line of the hulls.

12. A vessel as claimed in claim 1, wherein lattice members are also provided interconnecting lower ends of respective structural members adjacent the lower hull to upper ends of adjacent structural members on the hull above.

13. A vessel as claimed in claim 1, wherein the means to hold liquid ballast in the lower hull comprises a plurality of at least one of storage and ballast tanks to receive a liquid to be stored and said means for displacing liquid comprises means for filling and emptying the tanks as required.

14. A vessel as claimed in claim 1, wherein the upper hull has a plurality of storage tanks and means are provided for filling and emptying the tanks as required.

15. A vessel as claimed in claim 1, wherein a vertically rotatable turret is mounted in the hulls of the vessel towards one end of the vessel and means are provided for attaching an anchor system to the turret for mooring the vessel, the turret being freely rotatable with respect to the hulls of the vessel to allow the vessel to lie according to the dictates of at least one of the prevailing wind direction, current direction and wave direction.

16. A vessel as claimed in claim 15, wherein the hulls have axially aligned wells extending therethrough on a center line adjacent one end of the vessel, the turret extends through the walls and bearing means are provided for mounting the turret for rotation in the wells to receive said anchor system.

17. A vessel as claimed in claim 15, wherein a catenary anchor system is attached to the turret.

18. A vessel as claimed in claim 1 wherein a thruster is provided on at least one of the hulls for at least one of driving and maneuvering of the vessel.

19. A vessel as claimed in claim 1 wherein the upper hull has downwardly open side tanks having control valves at upper ends thereof for venting the tanks to provide a motion suppression system.

* * * * *